US007417415B2

(12) United States Patent
Yen et al.

(10) Patent No.: US 7,417,415 B2
(45) Date of Patent: Aug. 26, 2008

(54) VOLTAGE-CONTROLLED CURRENT SOURCE

(75) Inventors: Chih-Jen Yen, Hsinchu (TW); Chiu-Hung Cheng, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 473 days.

(21) Appl. No.: 11/160,135

(22) Filed: Jun. 10, 2005

(65) Prior Publication Data

US 2006/0125463 A1 Jun. 15, 2006

(30) Foreign Application Priority Data

Dec. 9, 2004 (TW) ..... 93138077 A

(51) Int. Cl.
*G05F 1/40* (2006.01)
*G05F 1/56* (2006.01)

(52) U.S. Cl. ..... 323/316; 323/315

(58) Field of Classification Search ..... 323/312, 323/314–317; 327/535, 537, 538, 540, 541, 327/543

See application file for complete search history.

(56) References Cited

U.S. PATENT DOCUMENTS

| | | | | |
|---|---|---|---|---|
| 5,021,730 | A * | 6/1991 | Smith | 323/316 |
| 6,057,727 | A * | 5/2000 | Dautriche et al. | 327/543 |
| 6,700,365 | B2 * | 3/2004 | Isham et al. | 323/317 |
| 6,747,508 | B2 * | 6/2004 | Liu et al. | 327/543 |
| RE38,657 | E * | 11/2004 | Pulvirenti | 323/277 |

* cited by examiner

*Primary Examiner*—Matthew V Nguyen
(74) *Attorney, Agent, or Firm*—Jianq Chyun IP Office

(57) ABSTRACT

A voltage-controlled current source (VCCS) is provided. The VCCS controls an output current according to a controlling voltage. The VCCS includes an operational amplifier (OP-amplifier), a transistor, a resistor and a current mirror. The present invention utilizes the characteristics of the OP-amplifier to compensate for the voltage difference between the gate and the source of the transistor so that the resulting terminal voltage on the resistor is equal to the input control voltage. Therefore, the VCCS of the present invention can reduce the factors including process drift, fluctuation in the DC voltage source or the output current that can affect the terminal voltage difference of the resistor and hence the accuracy of the output current.

28 Claims, 14 Drawing Sheets

VOLTAGE-CONTROLLED CURRENT SOURCE

CROSS-REFERENCE TO RELATED APPLICATION

This application claims the priority benefit of Taiwan application serial no. 93138077, filed on Dec. 9, 2004. All disclosure of the Taiwan application is incorporated herein by reference.

BACKGROUND OF THE INVENTION

1. Field of the Invention

The present invention relates to a current source. More particularly, the present invention relates to an interconnecting process and a voltage-controlled current source.

2. Description of the Related Art

In some electronic circuits, a voltage-controlled current source is often required to convert voltage signals into current signals. FIG. 1A is a circuit diagram of a conventional negatively related voltage-controlled current source. As shown in FIG. 1A, an input control voltage VBL fed to a transistor P1 is converted to another voltage at VL through a transistor P1 serving as a voltage converter. Then, the voltage difference between the node VL and the DC voltage source VDD is converted to a current flow through a resistor R. Thereafter, through a current mirror formed by a pair of transistors N21 and N22, a current IL is output. When the control voltage VBL increases, the voltage at the node VL will increase. As a result, the terminal voltage difference of the resistor will reduce, leading to a reduced output current IL. Hence, there is a negative relation in this voltage-controlled current source circuit. Because the resistor R receives the direct current voltage source VDD directly, any fluctuation in the DC voltage source VDD will affect the terminal voltage difference of the resistor R and then the voltage of the output current IL. FIG. 1B is a graph showing a relationship between the control voltage VBL versus output current IL for the circuit in FIG. 1A when the voltage of the voltage source VDD fluctuates. As shown in FIG. 1B, the horizontal axis indicates the change in the control voltage VBL and the vertical axis indicates the voltage of current flowing through the transistor N21 (or the voltage of the output current IL). Under the same input control voltage VBL, any changes in the DC voltage source VDD can affect the terminal voltage difference of the resistor R and result in a change in the voltage of the output current IL.

The control voltage (the voltage at the node VL), the real determinant of the voltage of the current flowing through the transistor N21 (or the voltage of the output current IL) still differs from the input control voltage VBL by a gate-source voltage (VGS) of the P-type transistor P1. However, the gate-source voltage (VGS) is not a fixed voltage. In general, the gate-source voltage (VGS) is related to the threshold voltage (Vth) and the output current of the MOS transistor P1. FIG. 1C is a graph showing a relationship between the control voltage VBL versus the output current IL for the circuit in FIG. 1A when the MOS transistor has different threshold voltage. As shown in FIG. 1C, the horizontal axis indicates the change in the control voltage VBL and the vertical axis indicates the voltage of the current flowing through the transistor N21 (or the output current IL). From FIG. 1C, it can be seen that when the input control voltage VBL remains unchanged, any change in the manufacturing process will affect the threshold voltage (Vth) of the MOS transistor P1 and thus the current generated will be different.

FIG. 2A is a circuit diagram of a conventional positively related voltage-controlled current source. As shown in FIG. 2A, an input control voltage VBH fed to an N-type transistor Ni is converted to another voltage at VH through the transistor Ni serving as a voltage converter. Then, the voltage difference between the node VH and a ground is converted to a current flow through a resistor R. Thereafter, through a current mirror formed by a pair of P-type transistors P21 and P22, a current IH is output. When the control voltage VBH increases, the voltage at the node VH will increase. As a result, the terminal voltage difference of the resistor R will increase, leading to an increased output current IH. Hence, in this voltage-controlled current source circuit, there is a positive relation between the control voltage and current source.

FIG. 2B is a graph showing a relationship between the control voltage VBH versus output current IH for the circuit in FIG. 2A when the DC voltage source VDD fluctuates. The horizontal axis indicates the change in the control voltage VBH and the vertical axis indicates the voltage of current flowing through the transistor P21 (or the value of the output current IH). As shown in FIG. 2B, the positively related voltage-controlled current source is hardly affected by any variation in the DC voltage source. This is because the transistor NI isolates the resistor from the DC voltage source VDD.

However, the control voltage (the voltage at the node VL), the real determinant of the voltage of current flowing through the transistor P21 (or the voltage of the output current IH) still differs from the input control voltage VBH by a gate-source voltage (VGS) of the transistor Ni. However, the gate-source voltage (VGS) is not a fixed voltage. FIG. 2C is a graph showing a relationship between the control voltage VBH and the output current IH for the circuit in FIG. 2A when the MOS transistor has different threshold voltage. As shown in FIG. 2C, the output current will change according to any drift in the manufacturing process, resulting in a change in the threshold voltage.

SUMMARY OF THE INVENTION

Accordingly, at least one objective of the present invention is to provide a voltage-controlled current source, capable of providing an accurate voltage different at two terminals of a resistor so that the output current can be precisely controlled.

At least a second objective of the present invention is to provide a voltage-controlled current source, besides the capability in the aforementioned objective, also capable of preventing possible changes in the threshold voltage (Vth) of a transistor due to a process drift, which will deviate the output current from the ideal value.

At least a third objective of the present invention is to provide a voltage-controlled current source, besides the capability in the aforementioned objectives, also capable of preventing any fluctuation in the DC voltage source or the ground voltage from affecting the output current.

At least a fourth objective of the present invention is to provide a voltage-controlled current source, besides the capability of the aforementioned objectives, also capable of serving as a positively related and negative related voltage-controlled current sources and providing positive and negative output current simultaneously. Furthermore, the output current from the voltage-controlled current can be precisely controlled.

At least a fifth objective of the present invention is to provide a voltage-controlled current source, besides the capability of the aforementioned objectives, also capable of using a simpler circuit to provide a positively and negatively related voltage-controlled current source and a positive and negative output current simultaneously.

To achieve these and other advantages and in accordance with the purpose of the invention, as embodied and broadly described herein, the invention provides a voltage-controlled current source for receiving a control voltage and using the control voltage to control the output current from the voltage-controlled current source. The voltage-controlled current source includes an operational amplifier, a first transistor, a resistor and a current mirror. A first input terminal of the operational amplifier receives the control voltage. A gate terminal of the first transistor is coupled to an output terminal of the operational amplifier and a first source/drain terminal of the first transistor is coupled to a second input terminal of the operational amplifier. One terminal of the resistor is coupled to a first voltage line and another terminal of the resistor is coupled to the first source/drain terminal of the first transistor. The current mirror has a reference side output terminal and an output side output terminal. The reference side output terminal is coupled to a second source/drain terminal of the first transistor while the output side output terminal generates an output current.

The present invention also provides a second voltage-controlled current source for receiving a control voltage and using the control voltage to control the output current. The voltage-controlled current includes an operational amplifier, a first transistor, a second transistor, a resistor and a current mirror. A first input terminal of the operational amplifier receives the control voltage. A gate terminal of the first transistor is coupled to an output terminal of the operational amplifier and a first source/drain terminal of the first transistor is coupled to a second input terminal of the operational amplifier. A gate terminal of the second transistor is coupled to the output terminal of the operational amplifier while a first source/drain terminal of the second transistor generates an output current. One terminal of the resistor is coupled to a first voltage line while the other terminal of the resistor is coupled to the first source/drain terminal of the first transistor. The current mirror has a reference side output terminal and an output side output terminal. The reference side output terminal is coupled to a second source/drain terminal of the first transistor while the output side output terminal is coupled to a second source/drain terminal of the second transistor.

The present invention also provides a third voltage-controlled current source for receiving a first control voltage and a second control voltage and using the first control voltage and the second control voltage to control a first output current and a second output current. The voltage-controlled current source includes a first operational amplifier, a second operational amplifier, a first transistor, a second transistor, a resistor, a first current mirror and a second current mirror. A first input terminal of the first operational amplifier receives the first control voltage and a first input terminal of the second operational amplifier receives the second control voltage. A gate terminal of the first transistor is coupled to an output terminal of the first operational amplifier and a first source/drain terminal of the first transistor is coupled to a second input terminal of the first operational amplifier. A gate terminal of the second transistor is coupled to an output terminal of the second operational amplifier and a first source/drain terminal of the second transistor is coupled to a second input terminal of the second operational amplifier. One terminal of the resistor is coupled to the first source/drain terminal of the first transistor and the other terminal of the resistor is coupled to the first source/drain terminal of the second transistor. The first current mirror and the second current mirror each has a reference side output terminal and an output side output terminal. The reference side output terminal of the first current mirror is coupled to a second source/drain terminal of the first transistor while the output side output terminal of the first current mirror outputs the first output current. Similarly, the reference side output terminal of the second current mirror is coupled to a second source/drain terminal of the second transistor while the output side output terminal of the second current mirror outputs the second output current.

The present invention also provides a fourth voltage-controlled current source for receiving a first control voltage and a second control voltage and using the first control voltage and the second control voltage to control a first output current and a second output current. The voltage-controlled current source includes a first operational amplifier, a second operational amplifier, a first transistor, a second transistor, a third transistor, a fourth transistor, a resistor, a first current mirror and a second current mirror. A first input terminal of the first operational amplifier receives the first control voltage and a first input terminal of the second operational amplifier receives the second control voltage. A gate terminal of the first transistor is coupled to an output terminal of the first operational amplifier and a first source/drain terminal of the first transistor is coupled to a second input terminal of the first operational amplifier. A gate terminal of the second transistor is coupled to the output terminal of the first operational amplifier while a first source/drain terminal of the second transistor outputs the first output current. A gate terminal of the third transistor is coupled to an output terminal of the second operational amplifier and a first source/drain terminal of the third transistor is coupled to a second input terminal of the second operational amplifier. A gate terminal of the fourth transistor is coupled to the output terminal of the second operational amplifier and a first source/drain terminal of the fourth transistor outputs the second output current. One terminal of the resistor is coupled to the first source/drain terminal of the first transistor and the other terminal of the resistor is coupled to the first source/drain terminal of the third transistor. The first current mirror and the second current mirror both have a reference side output terminal and an output side output terminal. The reference side output terminal of the first current mirror is coupled to a second source/drain terminal of the first transistor and the output side output terminal of the first current mirror is coupled to a second source/drain terminal of the second transistor. The reference side output terminal of the second current mirror is coupled to a second source/drain terminal of the third transistor and the output side output terminal of the second current mirror is coupled to a second source/drain terminal of the fourth transistor.

The present invention also provides a fifth voltage-controlled current source for receiving a first control voltage and a second control voltage and using the first control voltage and the second control voltage to control a first output current and a second output current. The voltage-controlled current source includes a first operational amplifier, a second operational amplifier, a first current mirror, a second current mirror and a resistor. A first input terminal of the first operational amplifier receives the first control voltage and a first input terminal of the second operational amplifier receives the second control voltage. The first current mirror and the second current mirror both have a reference side and an output side. A control terminal in the reference side controls a reference current from an output terminal in the reference side so that an output terminal in the output side outputs an output current corresponding to the reference current. The reference side control terminal of the first current mirror is coupled to an output terminal of the first operational amplifier while the output side control terminal of the first current mirror outputs the first output current. A reference side control terminal of the second current mirror is coupled to an output terminal of the second operational amplifier while an output side output terminal of the second current mirror outputs the second output current. One terminal of the resistor is coupled to a second input terminal of the first operational amplifier and the reference side output terminal of the first current mirror. The other terminal of the resistor is coupled to a second input terminal of the second operational amplifier and the reference side output terminal of the second current mirror.

In the present invention, the characteristics of operational amplifiers are used to compensate for the gate-to-source voltage difference so that the output current can avoid the impact caused by processing variations. In the embodiment of the present invention, operations amplifiers and transistors can also be added to the upper and lower terminal of the resistor. Hence, a positively related voltage-controlled current source and a negatively related voltage-controlled current source as well as output current in the positive and the negative direction can be provided. Consequently, the impact caused by the DC voltage source or the ground is further minimized.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1A:
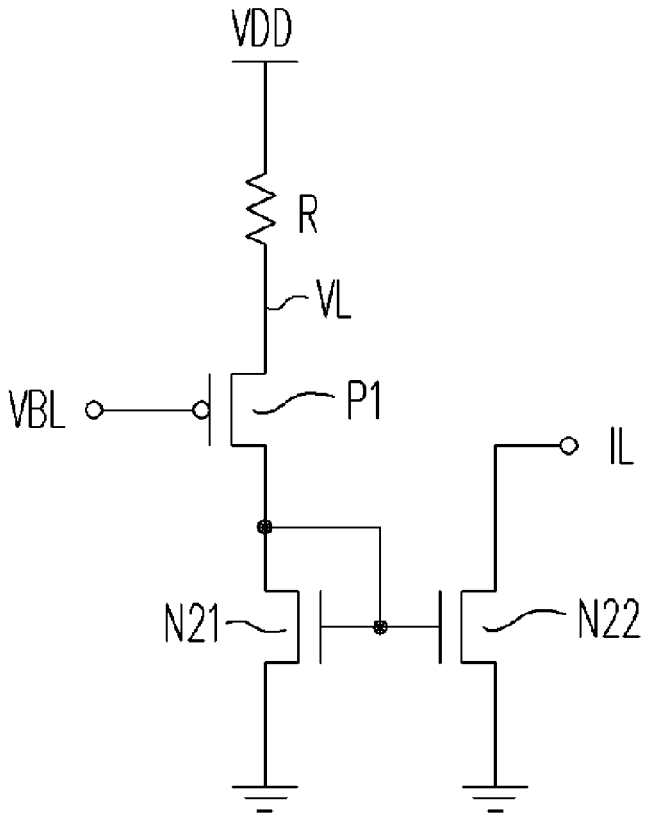
FIG. 1A (PRIOR ART)
FIG. 1A is a circuit diagram of a conventional negatively related voltage-controlled current source.
Figure 1B:
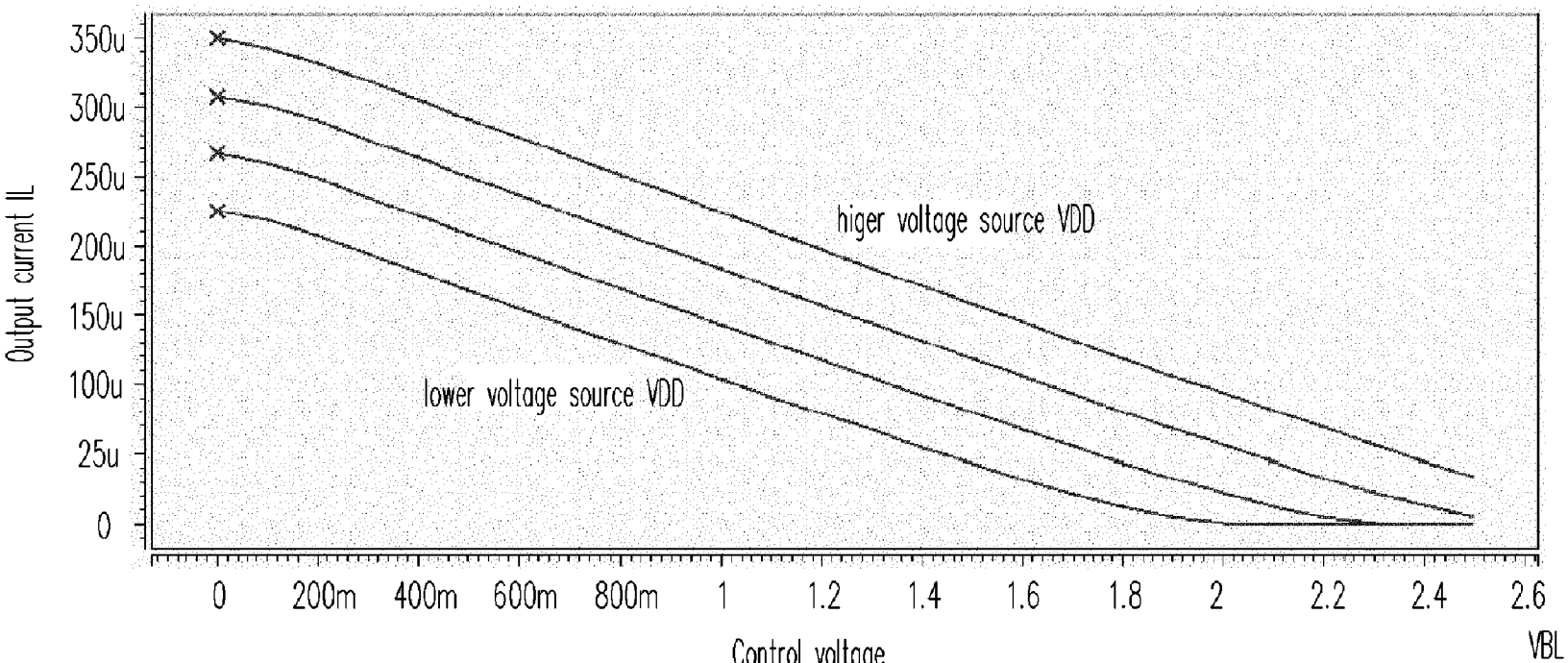
FIG. 1B (PRIOR ART)
FIG. 1B is a graph showing a relationship of the control voltage VBL versus output current IL for the circuit in FIG. 1A when the voltage of the voltage source VDD fluctuates.
Figure 1C:
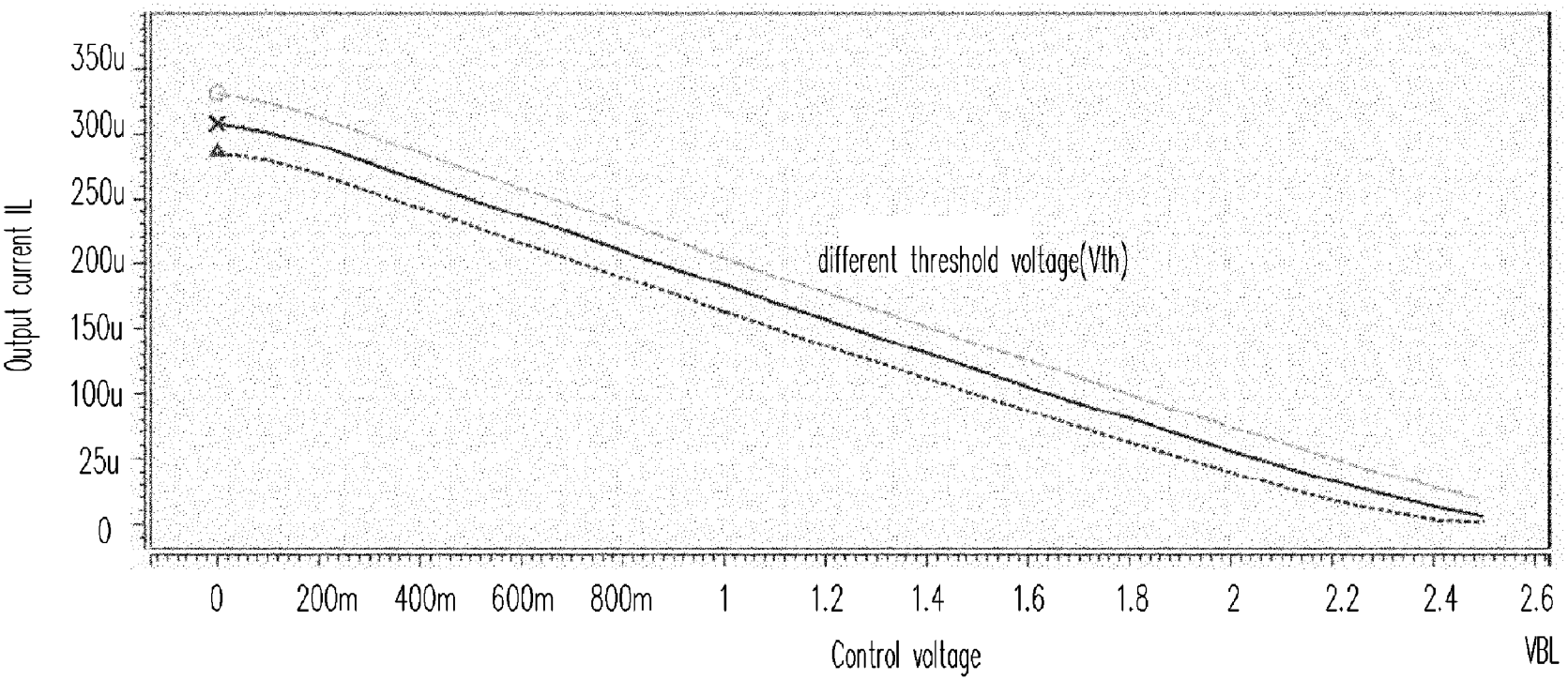
FIG. 1C (PRIOR ART)
FIG. 1C is a graph showing a relationship of the control voltage VBL versus the output current IL for the circuit in FIG. 1A when the MOS transistor has different threshold voltage.
Figure 2A:
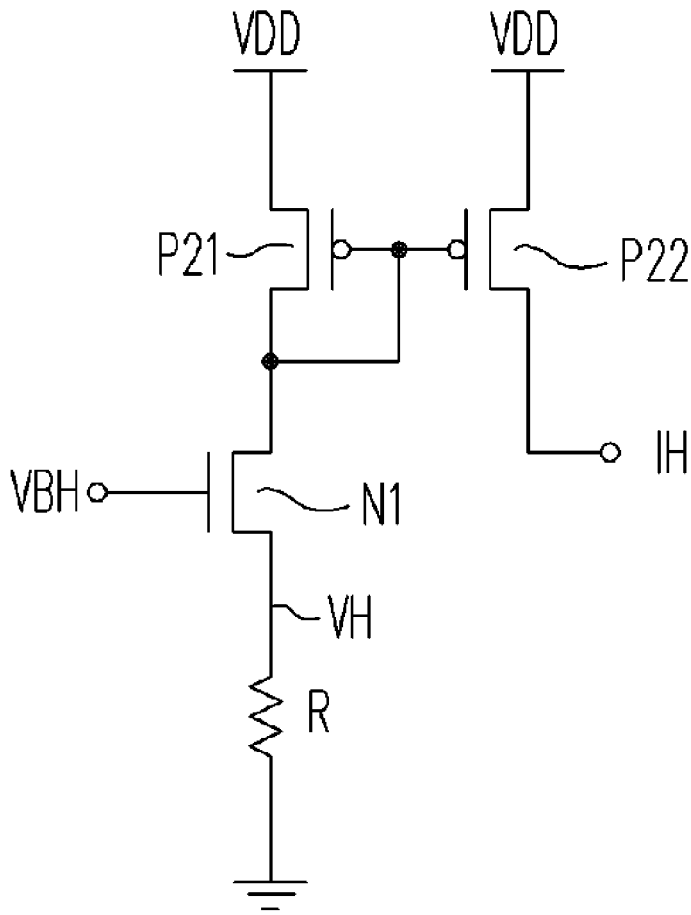
FIG. 2A (PRIOR ART)
FIG. 2A is a circuit diagram of a conventional positively related voltage-controlled current source.
Figure 2B:
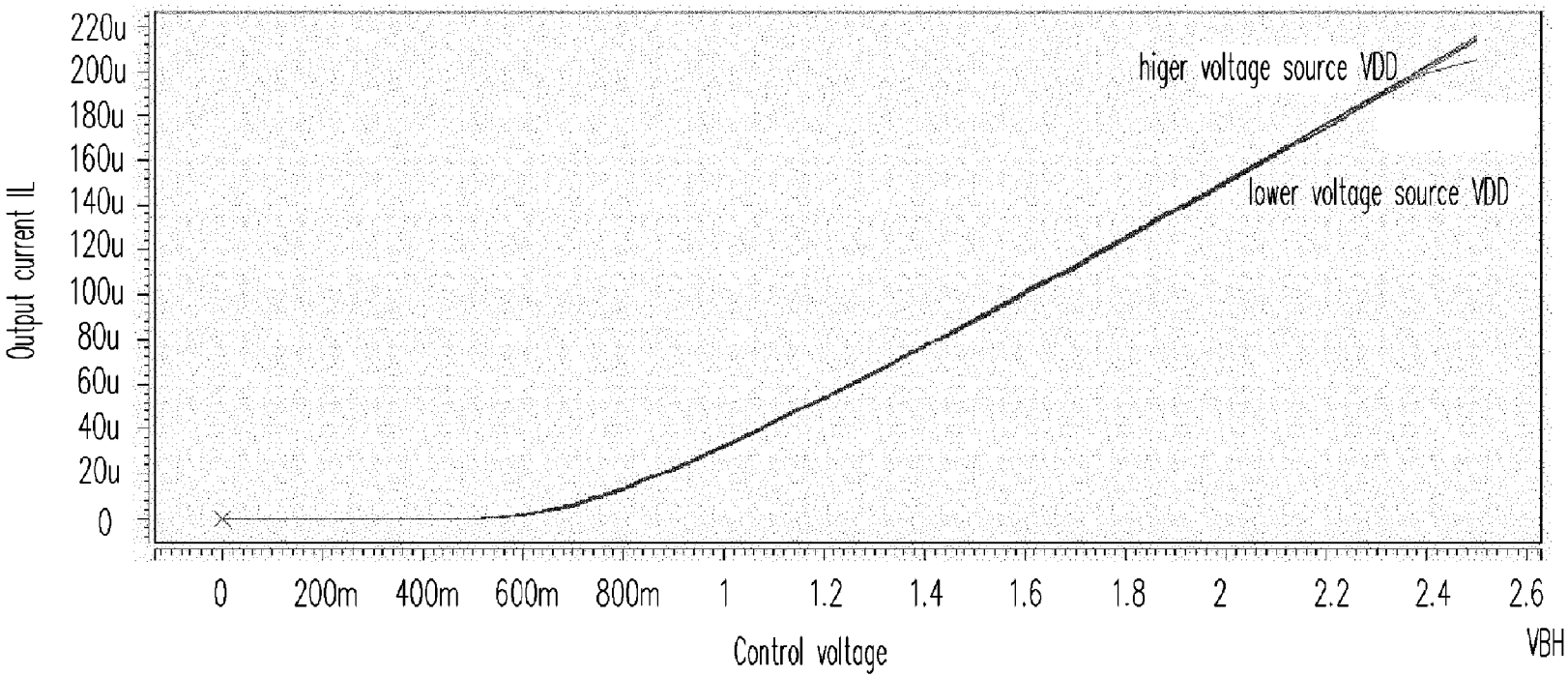
FIG. 2B (PRIOR ART)
FIG. 2B is a graph showing a relationship of the control voltage VBH versus output current IH for the circuit in FIG. 2A when the DC voltage source VDD fluctuates.
Figure 2C:
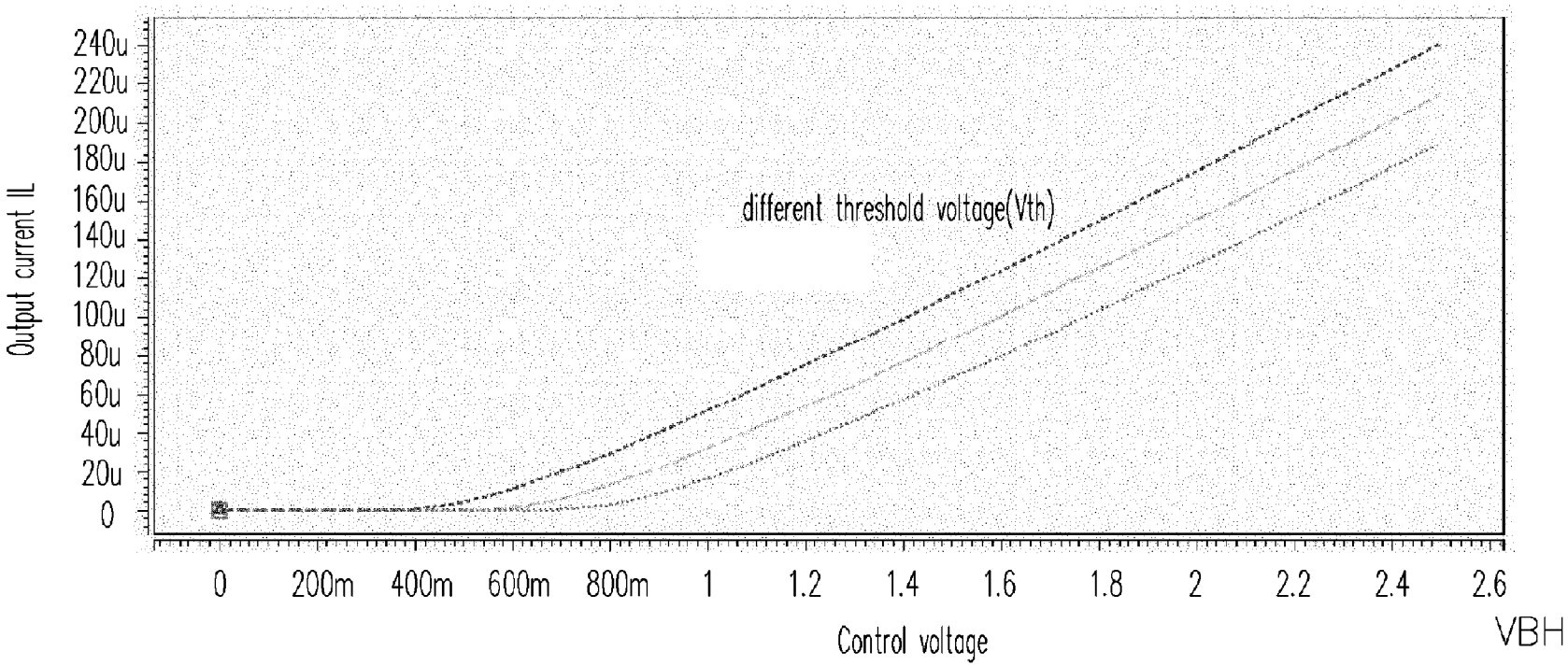
FIG. 2C (PRIOR ART)
FIG. 2C is a graph showing a relationship between the control voltage VBH and the output current IH for the circuit in FIG. 2A when the MOS transistor has different threshold voltage.

Reference will now be made in detail to the present embodiments of the invention, examples of which are illustrated in the accompanying drawings. Wherever possible, the same reference numbers are used in the drawings and the description to refer to the same or like parts.

Figure 3:
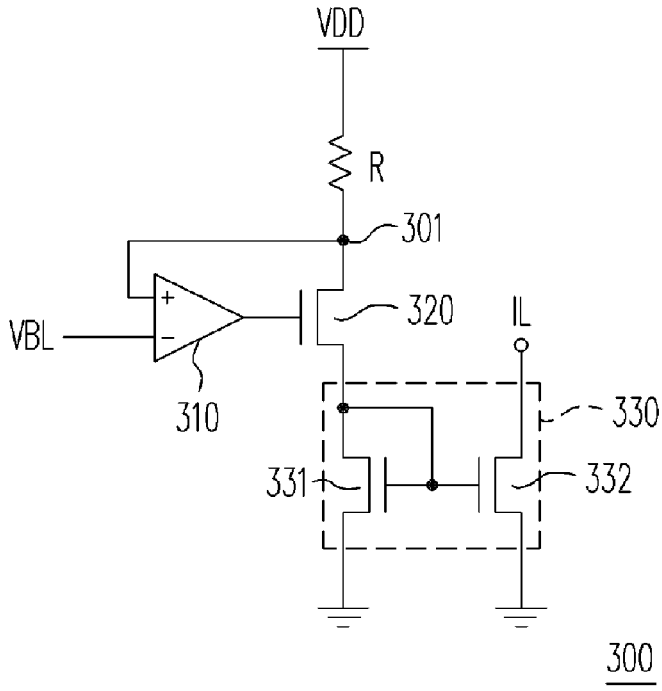
FIG. 3 is a circuit diagram of a negatively related voltage-controlled current source according to one embodiment of the present invention.

FIG. 3 is a circuit diagram of a negatively related voltage-controlled current source according to one embodiment of the present invention. As shown in FIG. 3, the voltage-controlled current source 300 receives a control voltage VBL and uses the control voltage VBL to control an output current IL. In the voltage-controlled current source 300, a first input terminal (for example, the negative input terminal) of an operational amplifier 310 receives the control voltage VBL. A gate terminal of a first transistor (an N-type transistor 320) is coupled to an output terminal of the operational amplifier 310 and a drain terminal of the transistor 320 is coupled to a second input terminal (for example, a positive input terminal) of the operational amplifier 310. One terminal of a resistor R is coupled to a first voltage line (for example, a power supply voltage line VDD) and the other terminal of the resistor R is coupled to the drain terminal of the transistor 320.

A current mirror 330 having a reference side and an output side is provided. The current mirror 330 is coupled to a ground wire. A reference side output terminal of the current mirror 330 is coupled to a source terminal of the transistor 320 while its output side output terminal generates the output current IL. Here, the current mirror 330 can be implemented according to the following embodiment. However, any one of ordinary skill in the art may know that the current mirror is not limited to the following embodiments. For example, various current mirrors including the cascode current mirrors and the Wilson current mirrors also fall within the scope of the present invention.

The current mirror 330 includes N-type transistors 331 and 332, for example. A drain terminal and a gate terminal of the transistor 331 are connected to each other. A source terminal of the transistor 331 is connected to a ground wire and the drain terminal of the transistor 331 is the reference side output terminal. A gate terminal of the transistor 332 is coupled to the gate of the transistor 331. A source terminal of the transistor 332 is connected to a ground wire and a drain terminal of the transistor 332 is the output side output terminal.

Through the operational amplifier 310 and the transistor 320, the voltage at the node 301 is compensated so that it has a voltage identical to the control voltage VBL. The difference in voltage between the node 301 and the DC voltage source VDD is converted to a current through the resistor R. Thereafter, the output current IL is output through the current mirror 330. When the control voltage VBL increases, the voltage at the node 301 also increases correspondingly. Hence, the voltage differential at the terminals of the resistor is minimized and the output current IL is reduced. Hence, the voltage-controlled current source 300 is a negatively related voltage-controlled current source. Furthermore, the voltage at the node 301 and the control voltage VBL are very close to each other. This not only prevents any process drift which changes the threshold voltage (Vth), but also reduces any changes in the gate-to-source voltage difference in the first transistor between the terminal voltage of the resistor and the input control voltage due to a change in the output current. Without the two contributing factors, deviation of the output current form the ideal value is prevented.

Figure 4:
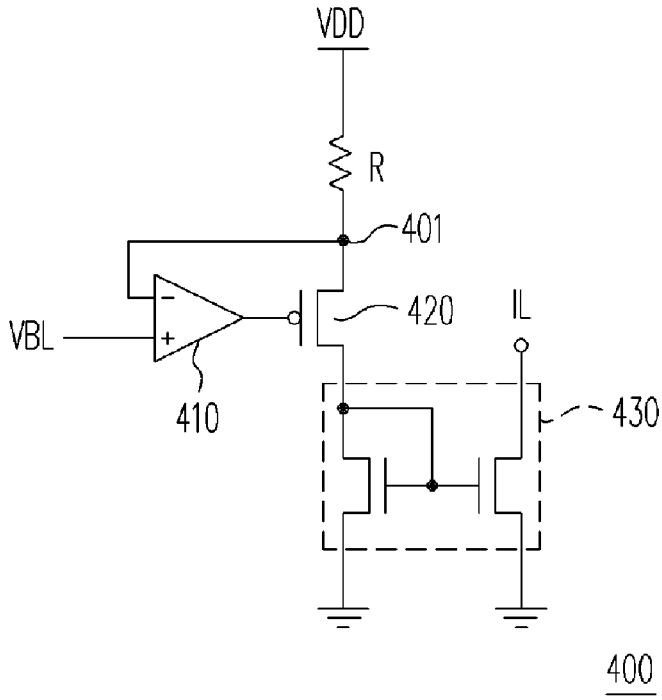
FIG. 4 is a circuit diagram of a negatively related voltage-controlled current source according to another embodiment of the present invention.

However, the application of the operational amplifier 310 in the aforementioned embodiment is not limited to the one shown in FIG. 3. FIG. 4 is a circuit diagram of a negatively related voltage-controlled current source according to another embodiment of the present invention. As shown in FIG. 4, the present embodiment is similar to the aforementioned embodiment in some ways. Hence, a description of the identical portions, for example, the current mirror 430, is not repeated.

In the voltage-controlled current source 400 of the present embodiment, the transistor 420 is a P-type transistor, for example. Furthermore, the positive input terminal of the operational amplifier 410 receives the control voltage VBL while the negative input terminal of the operational amplifier 410 is coupled to the node 401. Through the operational amplifier 410 and the transistor 420, the voltage at the node 401 is compensated so that it is identical to the control voltage VBL.

Figure 5:
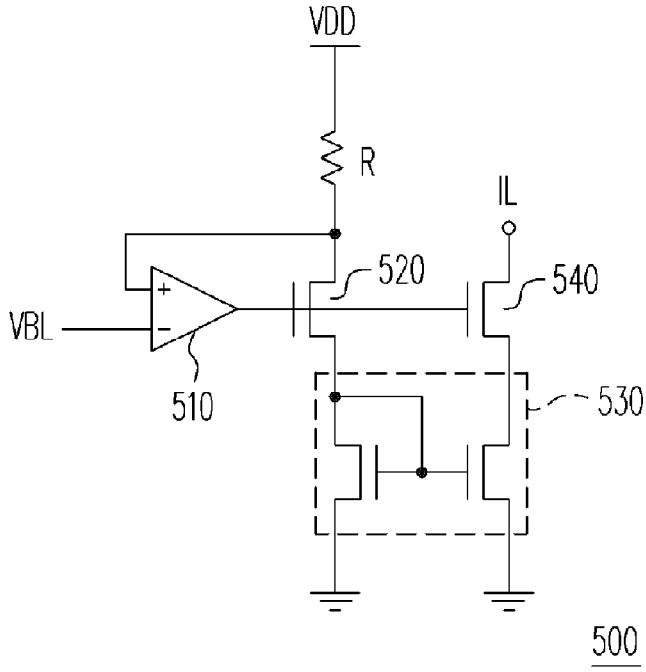
FIG. 5 is a circuit diagram of a negatively related voltage-controlled current source according to yet another embodiment of the present invention.

In addition, in the embodiment shown in FIG. 3, the output side output terminal of the current mirror 330 can generate the output current IL through the control of a transistor as shown in FIG. 5. FIG. 5 is a circuit diagram of a negatively related voltage-controlled current source according to yet another embodiment of the present invention. In the present embodiment, the voltage-controlled current source 500 is similar to the voltage-controlled current source 300 in the aforementioned embodiment. Hence, a description of the identical portions such as the operational amplifier 510, the transistor 520 and the current mirror 530 is not repeated. A gate terminal of an N-type transistor 540 is coupled to the output terminal of the operational amplifier 510 and a source terminal of the transistor 540 is coupled to the output side output terminal of the current mirror 530. A drain terminal of the transistor 540 generates the output current IL.

Figure 6:
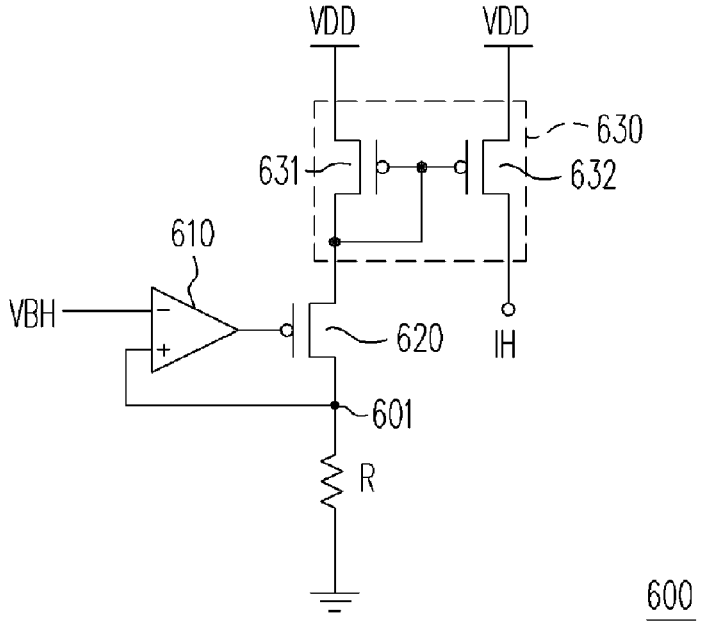
FIG. 6 is a circuit diagram of a positively related voltage-controlled current source according to one embodiment of the present invention.

FIG. 6 is a circuit diagram of a positively related voltage-controlled current source according to one embodiment of the present invention. As shown in FIG. 6, a voltage-controlled current source 600 receives a control voltage VBH and uses the control voltage VBH to control an output current IH. In the voltage-controlled current source 600, a first input terminal (for example, the negative input terminal) of an operational amplifier 610 receives the control voltage VBH. A gate terminal of a transistor 620 (a P-type transistor) is coupled to an output terminal of the operational amplifier 610 and a drain of the transistor 620 is coupled to a second input terminal (for example, the positive input terminal) of the operational amplifier 610. One terminal of a resistor R is coupled to a first voltage line (for example, a ground line) and the other terminal of the resistor R is coupled to the drain terminal of the transistor 620.

A current mirror 630 having a reference side and an output side is provided. The current mirror 630 is coupled to a power supply voltage line VDD. A reference side output terminal of the current mirror 630 is coupled to the source terminal of the transistor 620 while an output side output terminal of the current mirror 630 generates the output current IH. Here, the current mirror 630 can be implemented according to the following description.

The current mirror 630 comprises a pair of P-type transistors 631 and 632, for example. A drain terminal and a gate terminal of the transistor 631 are coupled to each other. A source terminal of the transistor 631 is coupled to the power supply voltage line VDD. The drain of the transistor 631 is the reference side output terminal. A gate terminal of the transistor 632 is coupled to the gate terminal of the transistor 631 and a source terminal of the transistor 632 is coupled to the power supply voltage line VDD. The drain of the transistor 632 is the output side output terminal.

Through the operational amplifier 610 and the transistor 620, the voltage at the node 601 is compensated so that it is identical to the control voltage VBH. The voltage difference between the voltage at the node 601 and the ground voltage is converted to a current flow through the resistor R. Thereafter, the output current IH is output through the current mirror 630. When the control voltage VBH increases, the voltage at the node 601 and the terminal voltage difference of the resistor also increase and hence the output current IH will increase. Therefore, the voltage-controlled current source 600 is a positively related voltage-controlled current. Furthermore, because the voltage at the node 601 is identical to the control voltage VBH, deviation of the output current from an ideal value due to a change in the threshold voltage (Vth) of the transistor caused by a process drift can be prevented.

Figure 7:
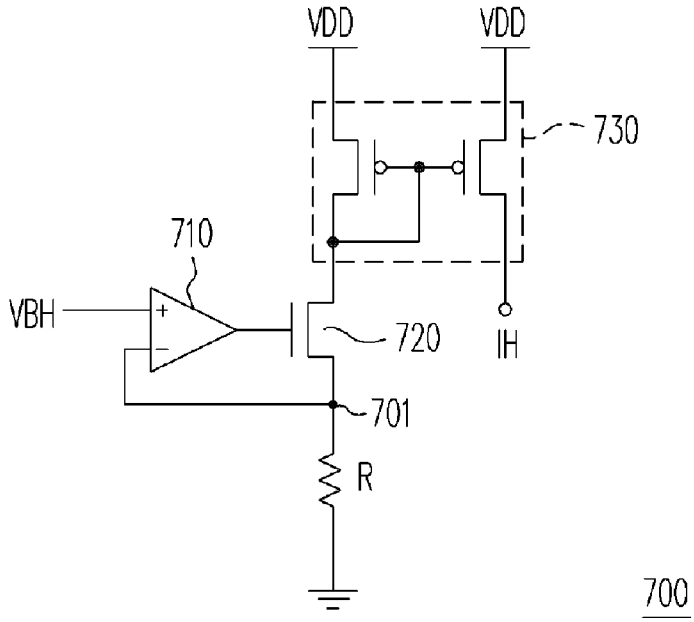
FIG. 7 is a circuit diagram of a positively related voltage-controlled current source according to another embodiment of the present invention.

However, the application of the operational amplifier 610 in the aforementioned embodiment is not limited to the one shown in FIG. 6. FIG. 7 is a circuit diagram of a positively related voltage-controlled current source according to another embodiment of the present invention. As shown in FIG. 7, the present embodiment is similar to the aforementioned embodiment in some ways. Hence, a description of the identical portions, for example, the current mirror 730, is not repeated.

In the voltage-controlled current source 700 of the present embodiment, the transistor 720 is an N-type transistor, instead of a P-type transistor 620 as shown in the voltage-controlled current source 600 of FIG. 6. Furthermore, a positive input terminal of an operational amplifier 710 receives the control voltage VBH while an negative input terminal of the operational amplifier 710 is coupled to the node 701. Through the operational amplifier 710 and the transistor 720, the voltage at the node 701 is compensated so that it is identical to the control voltage VBH.

Figure 8:
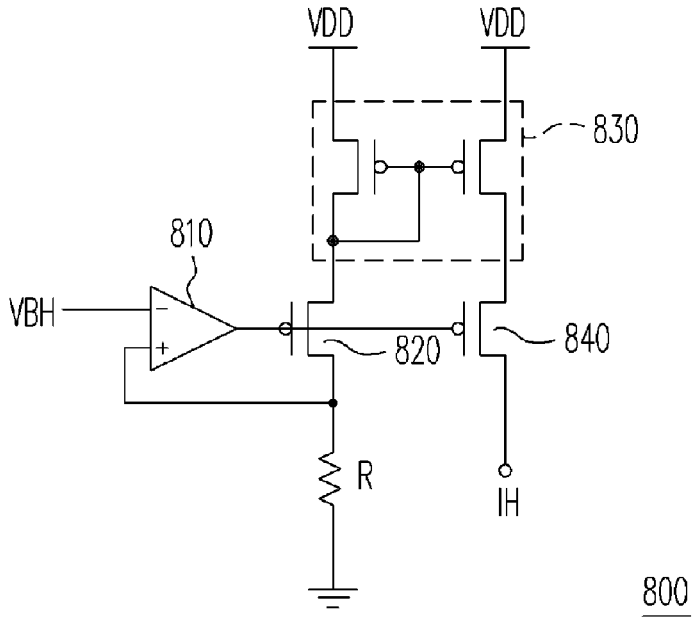
FIG. 8 is a circuit diagram of a positively related voltage-controlled current source according to yet another embodiment of the present invention.

In addition, in the embodiment shown in FIG. 6, the output side output terminal of the current mirror 630 can generate the output current IL through the control of a transistor as shown in FIG. 8. FIG. 8 is a circuit diagram of a positively related voltage-controlled current source according to yet another embodiment of the present invention. In the present embodiment, the voltage-controlled current source 800 is similar to the voltage-controlled current source 600 in the aforementioned embodiment. Hence, a description of the identical portions such as the operational amplifier 810, the transistor 820 and the current mirror 830 is not repeated. A gate terminal of a P-type transistor 840 is coupled to the output terminal of the operational amplifier 810 and a source terminal of the transistor 840 is coupled to the output side output terminal of the current mirror 830. A drain terminal of the transistor 840 generates the output current IH.

Figure 9:
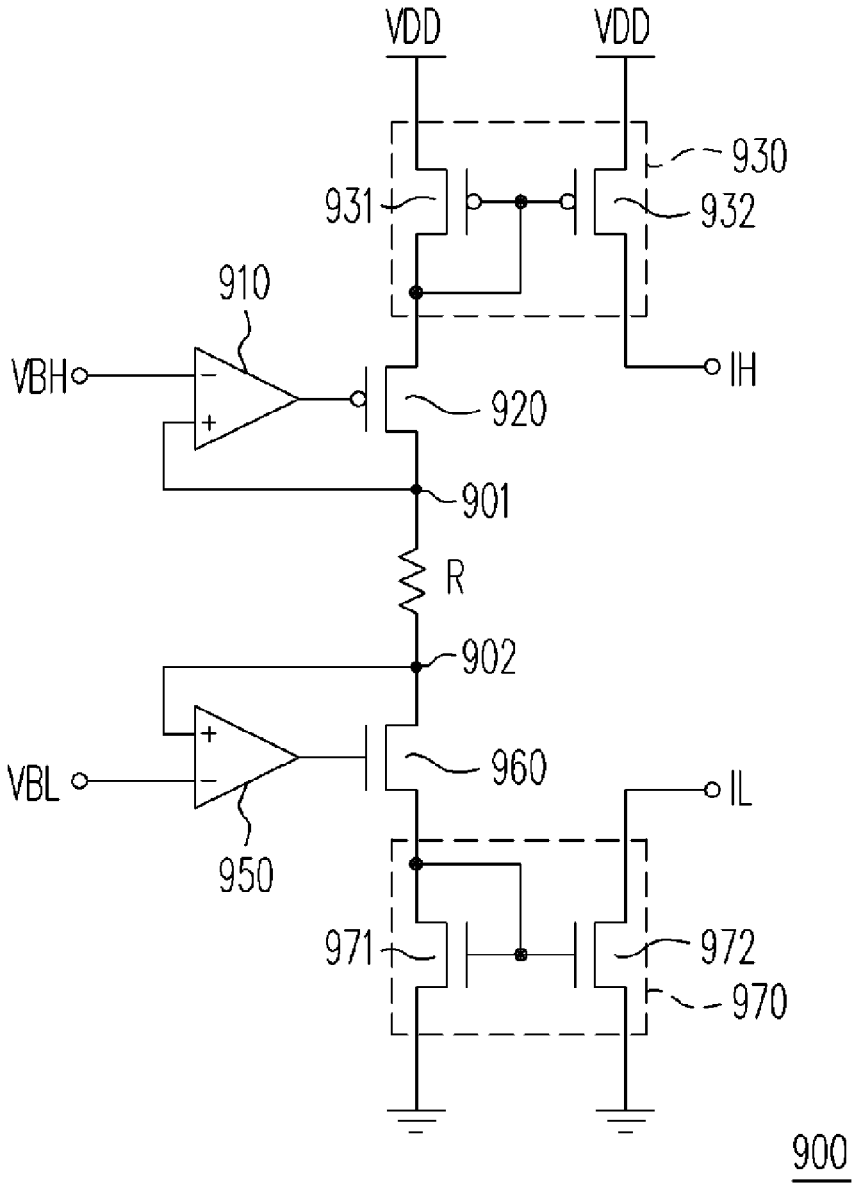
FIG. 9 is a circuit diagram of a voltage-controlled current source having a positively related voltage-controlled current source and a negatively related voltage-controlled current source according to one embodiment of the present invention.

To prevent any variation in the DC voltage source or ground voltage from affecting the output current, the present invention provides another embodiment. FIG. 9 is a circuit diagram of a voltage-controlled current source having a positively related voltage-controlled current source and a negatively related voltage-controlled current source according to one embodiment of the present invention. As shown in FIG. 9, a voltage-controlled current source 900 receives a first control voltage VBH and a second control voltage VBL and uses the first control voltage VBH and the second control voltage VBL to control a first output current IH and a second output current IL. The voltage-controlled current source 900 includes operational amplifiers 910 and 950, a P-type transistor 920, an N-type transistor 960, a resistor R and current mirrors 930 and 970.

A first input terminal (for example, a negative input terminal) of the operational amplifier 910 receives the first control voltage VBH and a first input terminal (for example, a negative input terminal) of the operational amplifier 950 receives the second control voltage VBL. A gate terminal of the transistor 920 is coupled to an output terminal of the operational amplifier 910 and a drain terminal of the transistor 920 is coupled to a second input terminal (for example, the positive input terminal) of the operational amplifier 910.

A gate terminal of the transistor 960 is coupled to an output terminal of the operational amplifier 950 and a drain terminal of the transistor 960 is coupled to a second input terminal (for example, a positive input terminal) of the operational amplifier 950. The terminals of the resistor R are coupled to the drain of the transistor 920 and the drain of the transistor 960 respectively.

The current mirrors 930 and 970 both have a reference side and an output side. The current mirror 930 is coupled to a power supply voltage line VDD. A reference side output terminal of the current mirror 930 is coupled to a source terminal of the transistor 920 while an output side output terminal of the current mirror 930 outputs the first output current IH. The current mirror 970 is coupled to a ground wire. A reference side output terminal of the current mirror 970 is coupled to a source of the transistor 960 while an output side output terminal of the current mirror 970 outputs the second output current IL. Here, the current mirrors 930 and 970 can be implemented according to the following description.

The current mirror 930 comprises a pair of P-type transistors 931 and 932. A drain and a gate terminal of the transistor 931 are coupled to each other, and a source of the transistor 931 is coupled to the power supply voltage line VDD. The drain of the transistor 931 is the reference side output terminal. A gate terminal of the transistor 932 is coupled to the gate terminal of the transistor 931 and a source of the transistor 932 is coupled to the power supply voltage line VDD. The drain of the transistor 932 is the output side output terminal.

The current mirror 970 comprises a pair of N-type transistors 971 and 972. A drain and a gate terminal of the transistor 971 are coupled to each other and a source of the transistor 931 is coupled to a ground wire. The drain of the transistor 971 is the reference side output terminal. A gate terminal of the transistor 972 is coupled to the gate terminal of the transistor 971 and a source of the transistor 932 is coupled to a ground wire. The drain of the transistor 972 is the output side output terminal.

Through the operational amplifier 910 and the transistor 920 and the operational amplifier 950 and the transistor 960, the voltage at the nodes 901 and 902 are compensated to a level identical to the control voltage VBH and the control voltage VBL respectively. The voltage difference between the node 901 and the node 902 is converted to a current flow through the resistor R. Thereafter, the current is output as the output current IH and the output current IL after passing through the current mirrors 930 and 970.

To minimize the impact of any change on the DC voltage source VDD or the ground for the voltage-controlled current source 900, operational amplifiers and transistors are added to the upper and lower terminal of the resistor R. Furthermore, the P-channel current mirror 930 and the N-channel current mirror 970 are also added. When the control voltage VBH increases, the voltage at the node 901 will increase correspondingly. As a result, the voltage difference between the terminals of the resistor R will increase, leading to increased output current IH and IL. Similarly, when the control voltage VBL increases, the voltage at the node 902 will increase correspondingly. As a result, the voltage difference between the terminals of the resistor R will decrease, leading to decreased output current IH and IL. Consequently, the voltage-controlled current source 900 has both a positively related voltage-controlled current source and a negatively related voltage-controlled current source and can provide a positive and a negative current output.

Further, because the voltage at the node 901 is identical to the control voltage VBH and the voltage at the node 902 is identical to the control voltage VBL, deviation of the output current from an ideal value due a change in the threshold voltage (Vth) caused by a process drift can be prevented.

Figure 10:
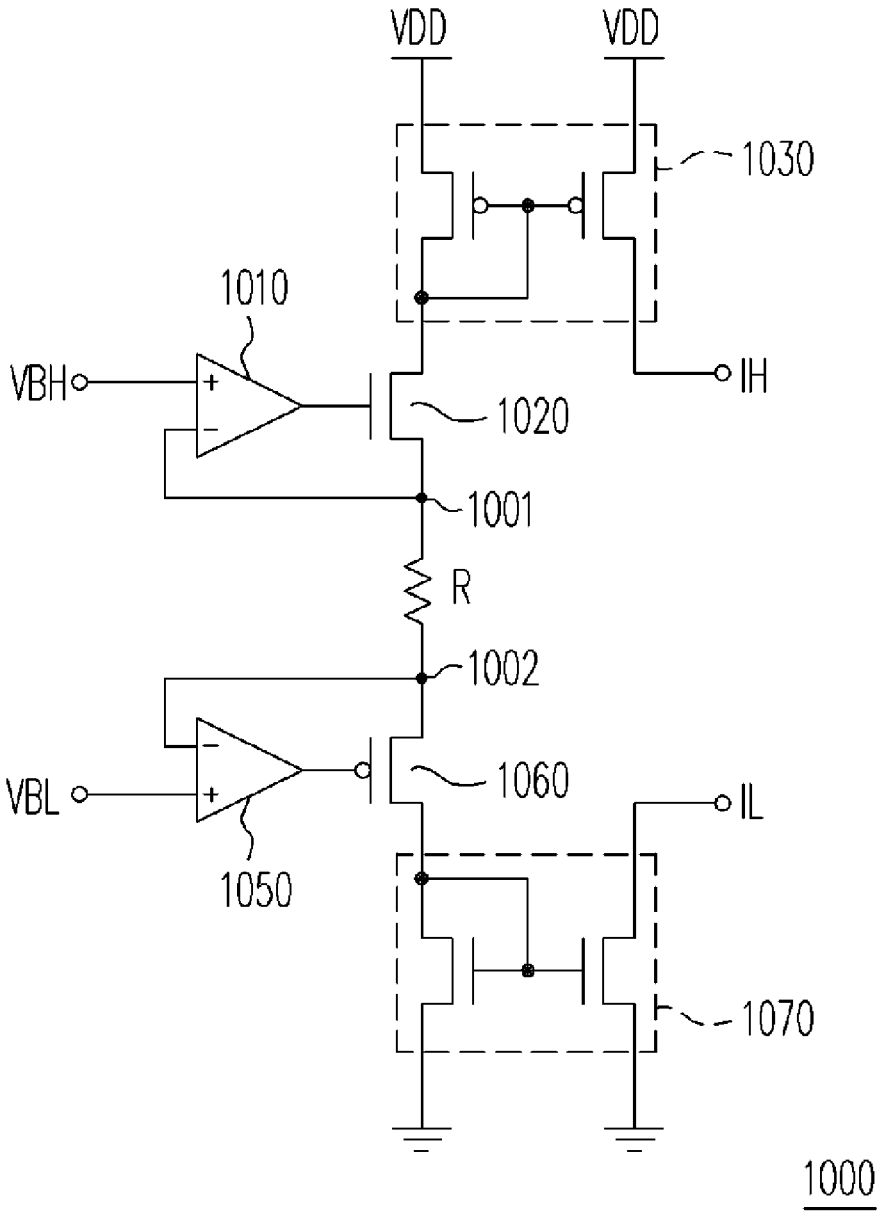
FIG. 10 is a circuit diagram of a voltage-controlled current source having a positively related voltage-controlled current source and a negatively related voltage-controlled current source according to another embodiment of the present invention.

However, the implementation of the operational amplifiers 910 and 950 in the aforementioned embodiment is not limited to the voltage-controlled current source 900 in FIG. 9. FIG. 10 is a circuit diagram of a voltage-controlled current source having a positively related voltage-controlled current source and a negatively related voltage-controlled current source according to another embodiment of the present invention. As shown in FIG. 10, the voltage-controlled current source 1000 in the present embodiment is very similar to the voltage-controlled current source 900 shown in FIG. 9. Hence, a description of the identical portions such as the current mirrors 1030 and 1070 is not repeated.

In the voltage-controlled current source 1000 of the present invention, an N-type transistor 1020 and a P-type transistor 1060 are provided. Here, a positive input terminal of an operational amplifier 1010 receives the control voltage VBH and a negative input terminal of the operational amplifier 1010 is coupled to a node 1001. Furthermore, a positive input terminal of an operational amplifier 1050 receives the control voltage VBL and a negative input terminal of the operational amplifier 1050 is coupled to a node 1002. Through the operational amplifier 1010 and the transistor 1020 and the operational amplifier 1050 and the transistor 1060, the voltage at the nodes 1001 and 1002 are compensated to a level identical to the control voltage VBH and VBL, respectively.

Figure 11:
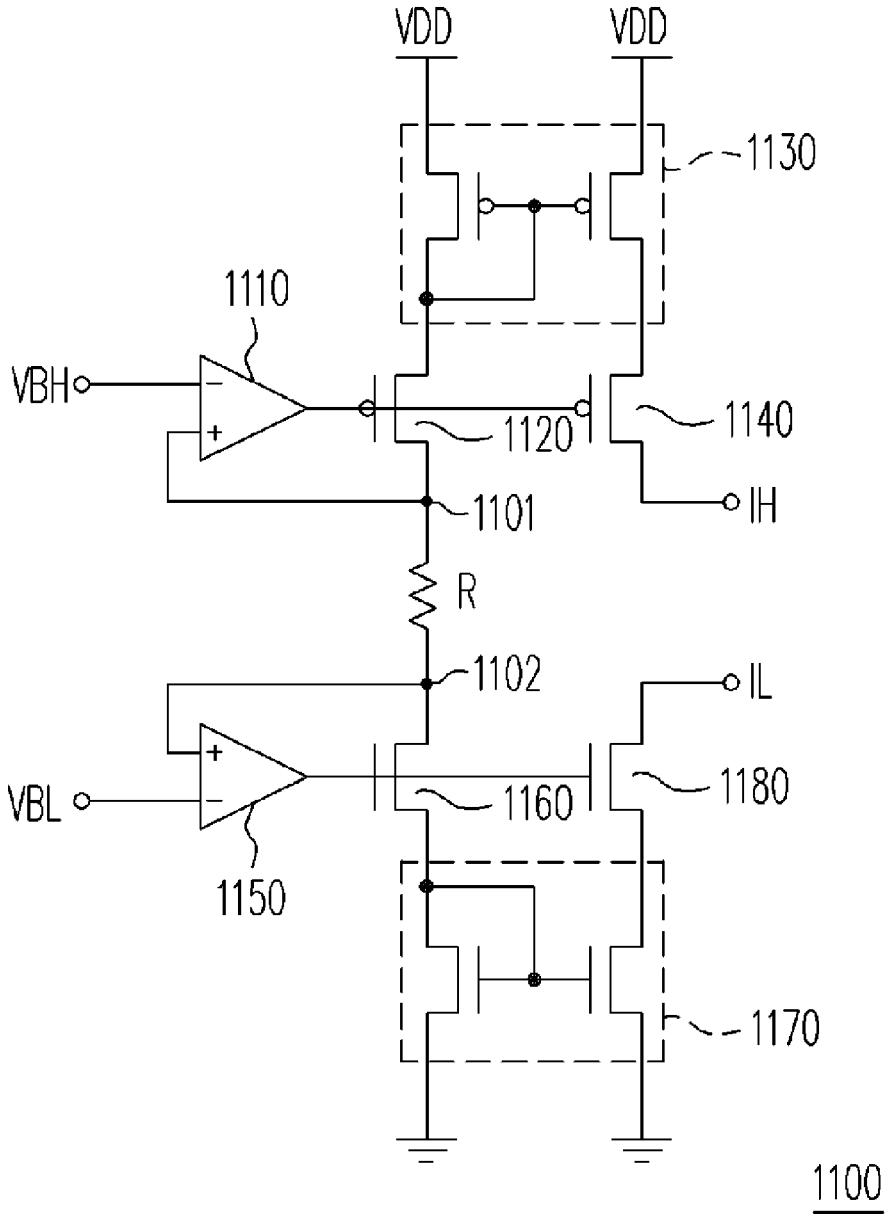
FIG. 11 is a circuit diagram of a voltage-controlled current source having a positively related voltage-controlled current source and a negatively related voltage-controlled current source according to yet another embodiment of the present invention.

In the embodiment of FIG. 9, the output side output terminal of the current mirrors 930 and 970 can be serially connected to a common gate group of transistors to generate the output currents IH and IL as shown in FIG. 11. FIG. 11 is a circuit diagram of a voltage-controlled current source having a positively related voltage-controlled current source and a negatively related voltage-controlled current source according to yet another d embodiment of the present invention. The voltage-controlled current source 1100 in the present embodiment is similar to the voltage-controlled current source 900 in FIG. 9. Hence, a description of the identical portions such as the operational amplifiers 1110 and 1150, the transistors 1120 and 1160 and the current mirrors 1130 and 1170 is not repeated. A gate terminal of a P-type transistor 1140 is coupled to an output terminal of the operational amplifier 1110 and a source terminal of the transistor 1140 is coupled to an output side output terminal of the current mirror 1130. A drain terminal of the transistor 1140 generates the output current IH. Similarly, a gate terminal of an N-type transistor 1180 is coupled to an output terminal of the operational amplifier 1150 and a source terminal of the transistor 1180 is coupled to an output side output terminal of the current mirror 1170. A drain terminal of the transistor 1180 generates the output current IL.

Figure 12:
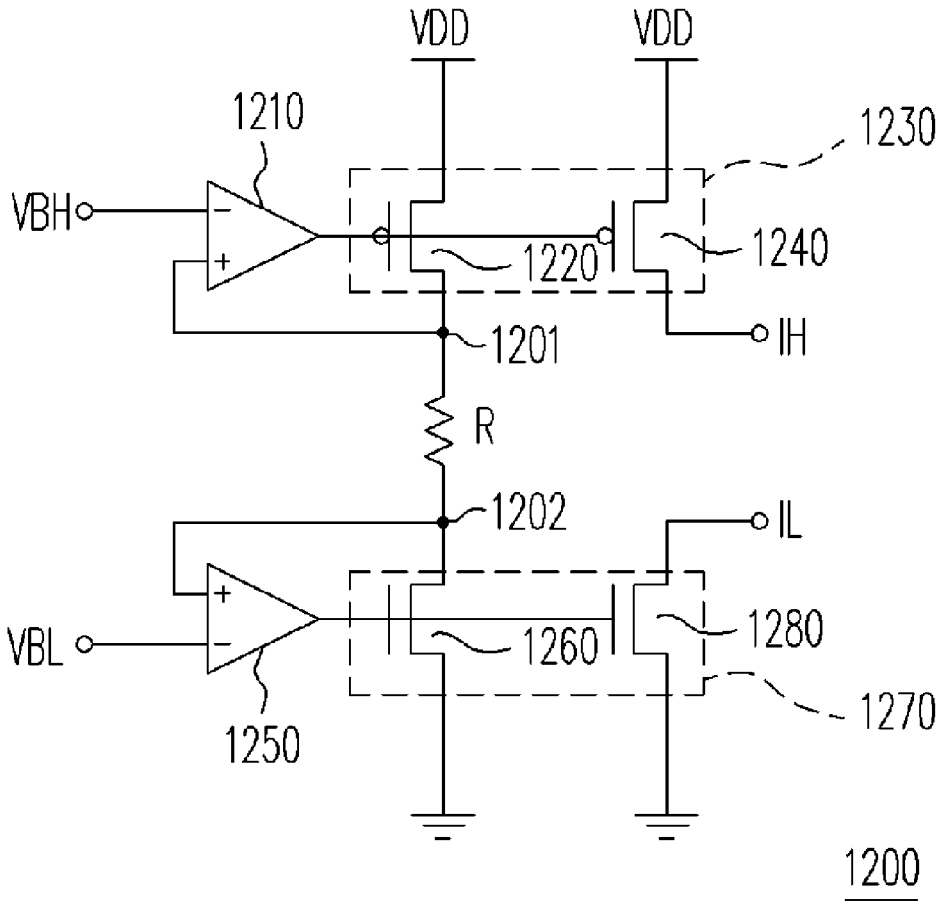
FIG. 12 is a circuit diagram of a voltage-controlled current source having a positively related voltage-controlled current source and a negatively related voltage-controlled current source as well as a variable current mirror according to one embodiment of the present invention.

In the aforementioned embodiment of the voltage-controlled current source 1100, the current mirrors 1130 and 1170 may be removed according to the actual requirement as shown in FIG. 12. FIG. 12 is a circuit diagram of a voltage-controlled current source having a positively related voltage-controlled current source and a negatively related voltage-controlled current source as well as a variable current mirror according to one embodiment of the present invention. The voltage-controlled current source 1200 receives a first control voltage VBH and a second control voltage VBL and uses the first control voltage VBH and the second control voltage VBL to control a first output current IH and a second output current IL, respectively. The voltage-controlled current source 1200 comprises a first operational amplifier 1210, a second operational amplifier 1250, a first current mirror 1230, a second current mirror 1270 and a resistor R. The first current mirror 1230 further comprises a first transistor 1220 (for example, a P-type transistor) and a second transistor 1240 (for example, a P-type transistor). The second current mirror 1270 further comprises a third transistor 1260 (for example, an N-type transistor) and a fourth transistor 1280 (for example, an N-type transistor).

A first input terminal (for example, a negative input terminal) of the operational amplifier 1210 receives the first control voltage VBH and a first input terminal (for example, a negative input terminal) of the operational amplifier 1250 receives the second control voltage VBL. A gate terminal of the transistor 1220 and the transistor 1240 are coupled to an output terminal of the operational amplifier 1210. A drain terminal of the transistor 1220 is coupled to a second input terminal (for example, a positive input terminal) of the operational amplifier 1210 and a source terminal of the transistor 1220 is coupled to a power supply voltage line VDD. A drain terminal of the transistor 1240 outputs the first output current IH. A source terminal of the transistor 1240 is coupled to the power supply voltage line VDD. A gate terminal of the transistor 1260 and the transistor 1280 are coupled to an output terminal of the operational amplifier 1250. A drain terminal of the transistor 1260 is coupled to a second input terminal (for example, a positive input terminal) of the operational amplifier 1250. A source terminal of the transistor 1260 is connected to a ground wire. A drain terminal of the transistor 1280 outputs the second output current IL. A source terminal of the transistor 1280 is coupled to the ground wire. The terminals of the resistor R are coupled to the drain terminal of the transistor 1220 and 1260, respectively.

Through the operational amplifier 1210 and the transistor 1220, the voltage at the node 1201 is compensated so that it is identical to the control voltage VBH. Through the operational amplifier 1250 and the transistor 1260, the voltage at the node 1202 is compensated so that it is identical to the control voltage VBL. The voltage difference between the node 1201 and the node 1202 is converted to a current flow through the resistor R. Thereafter, through the control of the transistor 1240 and 1280, the output currents IH and IL are generated.

Figure 13:
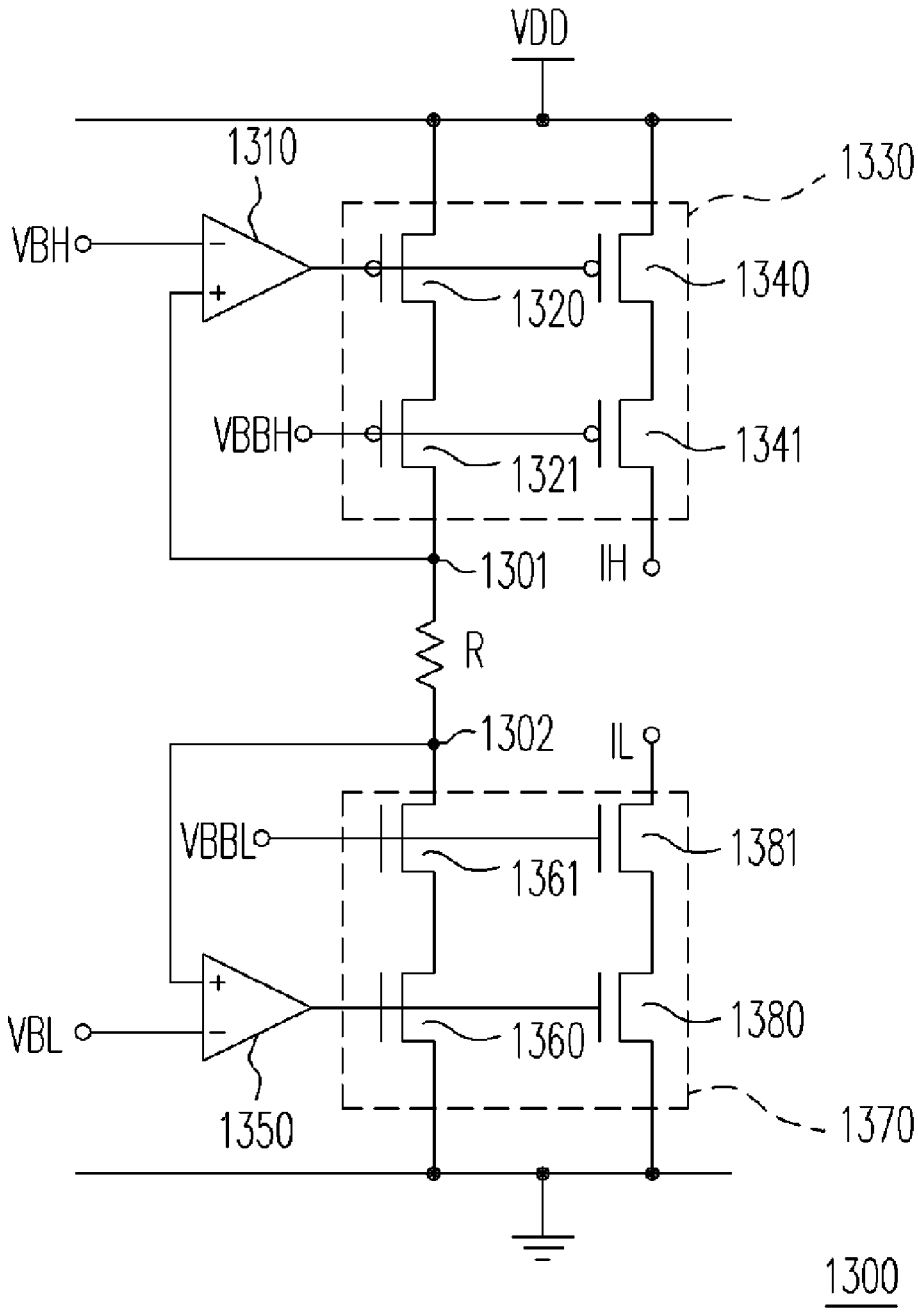
FIG. 13 is a circuit diagram of a voltage-controlled current source having a positively related voltage-controlled current source and a negatively related voltage-controlled current source as well as a variable current mirror according to another embodiment of the present invention.

Anyone of ordinary skill in the art may modify the design of the current mirrors 1230 and 1270 in the aforementioned voltage-controlled current source 1200 without departing from the spirit of the present invention. FIG. 13 is a circuit diagram of a voltage-controlled current source having a positively related voltage-controlled current source and a negatively related voltage-controlled current source as well as a variable current mirror according to another embodiment of the present invention. The voltage-controlled current source 1300 is very similar to the voltage-controlled current source 1200 shown in FIG. 12. One major difference between them is in the design of the current mirrors 1330 and 1370.

The first current mirror 1330 and the second current mirror 1370 both have a reference side and an output side for controlling a reference current flowing from a reference side output terminal according to a control terminal and a bias voltage terminal in the reference side so that the output current flowing from an output side output terminal corresponds with the reference current. In the present embodiment, the current mirror 1330 further comprises P-type transistors 1320, 1321, 1340 and 1341. Similarly, the current mirror 1370 further comprises N-type transistors 1360, 1361, 1380 and 1381.

A first input terminal (for example, a negative input terminal) of the operational amplifier 1310 receives the first control voltage VBH and a first input terminal (for example, a negative input terminal) receives the second control voltage VBL. In the first current mirror 1330, a gate of the transistor 1320 and the transistor 1340 (that is, a reference side control terminal of the current mirror 1330) are coupled to an output terminal of the operational amplifier 1310. A source terminal of the transistors 1320 and 1340 (of the current mirror 1330) are coupled to the power supply voltage line VDD. A drain terminal of the transistor 1320 is coupled to a source terminal of the transistor 1321. A gate terminal of the transistor 1321 and the transistor 1341 (that is, a reference side bias voltage terminal of the current mirror 1330) receives a fixed bias voltage VBBH. A drain terminal of the transistor 1321 (that is, a reference side output terminal of the current mirror 1330), a second input terminal (for example, a positive input terminal) of the operational amplifier 1310 and one terminal of the resistor R are coupled to a node 1301. A drain terminal of the transistor 1340 is coupled to a source terminal of the transistor 1341. A drain terminal of the transistor 1341 (that is, an output side output terminal of the current mirror 1330) outputs the first output current IH.

In the second current mirror 1370, a gate of the transistor 1360 and the transistor 1380 (that is, a reference side control terminal of the current mirror 1370) are coupled to an output terminal of the operational amplifier 1350. A source terminal of the transistor 1360 and 1380 (of the current mirror 1370) are coupled to a ground wire. A drain terminal of the transistor 1360 is coupled to a source terminal of the transistor 1361 and a drain terminal of the transistor 1380 is coupled to a source terminal of the transistor 1381. A gate terminal of the transistor 1361 and the transistor 1381 (that is, a reference side bias voltage terminal of the current mirror 1370) receives a fixed bias voltage VBBL. A drain terminal of the transistor 1361 (that is, a reference side output terminal of the current mirror 1370), a second input terminal (for example, a positive input terminal) of the operational amplifier 1350 and one terminal of the resistor R are coupled to a node 1302. A drain terminal of the transistor 1381 (that is, an output side output terminal of the current mirror 1370) outputs the second output current IL.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A voltage-controlled current source for receiving a control voltage and using the control voltage to control an output current, the voltage-controlled current source comprising:

an operational amplifier having a first input terminal for receiving the control voltage;

a first transistor, wherein a gate terminal of the first transistor is coupled to an output terminal of the operational amplifier and a first source/drain terminal of the first transistor is coupled to a second input terminal of the operational amplifier;

a second transistor, wherein a gate terminal of the second transistor is coupled to the output terminal of the operational amplifier and a first source/drain terminal of the second transistor outputs the output current;

a resistor, wherein one terminal of the resistor is coupled to a first voltage line and the other terminal of the resistor is coupled to the first source/drain terminal of the first transistor; and a current mirror having a reference side input terminal and an output side output terminal, wherein the reference side output terminal is coupled to a second source/drain terminal of the first transistor and the output side output terminal is coupled to a second source/drain terminal of the second transistor.

2. The voltage-controlled current source of claim 1, wherein the first voltage line comprises a power supply voltage line.

3. The voltage-controlled current source of claim 2, wherein the current mirror further comprises:

a third N-type transistor, wherein a source terminal of the third N-type transistor is coupled to a ground wire and a drain terminal of the third N-type transistor is coupled to a gate terminal of the third N-type transistor, wherein the drain terminal of the third N-type transistor is the reference side output terminal; and a fourth N-type transistor, wherein a source terminal of the fourth N-type transistor is coupled to the ground wire and a gate terminal of the fourth N-type transistor is coupled to the gate terminal of the third N-type transistor, wherein a drain terminal of the fourth N-type transistor is the output side output terminal.

4. The voltage-controlled current source of claim 2, wherein the first transistor and the second transistor are N-type transistors and the first input terminal and the second input terminal of the operational amplifier are a negative input terminal and a positive input terminal, respectively.

5. The voltage-controlled current source of claim 1, wherein the first voltage line comprises a ground wire.

6. The voltage-controlled current source of claim 5, wherein the current mirror farther comprises:

a third P-type transistor, wherein a source terminal of the third P-type transistor is coupled to a power supply voltage line and a drain terminal of the third P-type transistor is coupled to a gate terminal of the third P-type transistor, wherein the drain of the third P-type transistor is the reference side output terminal; and a fourth P-type transistor, wherein a source terminal of the fourth P-type transistor is coupled to the power supply voltage line and a gate terminal of the fourth P-type transistor is coupled to the gate terminal of the third P-type transistor, wherein the drain of the fourth P-type transistor is the output side output terminal.

7. The voltage-controlled current source of claim 5, wherein the first transistor and the second transistor are P-type transistors and the first input terminal and the second input terminal of the operational amplifier are a negative input terminal and a positive input terminal, respectively.

8. A voltage-controlled current source for receiving a first control voltage and a second control voltage and using the first control voltage and the second control voltage to control a first output current and a second output current, respectively, the voltage-controlled current source comprising:

a first operational amplifier, wherein a first input terminal of the first operational amplifier receives the first control voltage;

a second operational amplifier, wherein a first input terminal of the second operational amplifier receives the second control voltage;

a first transistor, wherein a gate terminal of the first transistor is coupled to an output terminal of the first operational amplifier and a first source/drain terminal of the first transistor is coupled to a second input terminal of the first operational amplifier;

a second transistor, wherein a gate terminal of the second transistor is coupled to an output terminal of the second operational amplifier and a first source/drain terminal of the second transistor is coupled to a second input terminal of the second operational amplifier;

a resistor, wherein one terminal of the resistor is coupled to the first source/drain terminal of the first transistor and the other terminal of the resistor is coupled to the first source/drain terminal of the second transistor;

a first current mirror having a reference side output terminal and an output side output terminal, wherein the reference side output terminal of die first current mirror is coupled to a second source/drain terminal of the first transistor and the output side output terminal of the first current mirror outputs the first output current; and a second current mirror having a reference side output terminal and an output side output terminal, wherein the reference side output terminal of the second current mirror is coupled to a second source/drain terminal of the second transistor and the output side output terminal of the second current mirror outputs the second output current.

9. The voltage-controlled current source of claim 8, wherein the first current mirror further comprises:

a third P-type transistor, wherein a source terminal of the third P-type transistor is coupled to a power supply voltage line and a drain terminal of the third P-type transistor is coupled to a gate terminal of the third P-type transistor, wherein the drain terminal of the third P-type transistor is the reference side output terminal; and a fourth P-type transistor, wherein a source terminal of the fourth P-type transistor is coupled to the power supply voltage line and a gate terminal of die fourth P-type transistor is coupled to the gate terminal of the third P-type transistor, wherein a drain terminal of the fourth P-type transistor is the output side output terminal.

10. The voltage-controlled current source of claim 8, wherein the second current mirror further comprises:

a third N-type transistor, wherein a source terminal of the third N-type transistor is coupled to a ground wire and a drain terminal of the third N-type transistor is coupled to a gate terminal of the third N-type transistor, wherein the drain terminal of the third N-type transistor is the reference side output terminal; and a fourth N-type transistor, wherein a source terminal of the fourth N-type transistor is coupled to a ground wire and a gate terminal of the fourth N-type transistor is coupled to the gate terminal of the third N-type transistor, wherein a drain terminal of the fourth N-type transistor is the output side output terminal.

11. The voltage-controlled current source of claim 8, wherein the first transistor is a P-type transistor and the first input terminal and the second input terminal of the first operational amplifier are negative input terminal and positive input terminal, respectively.

12. The voltage-controlled current source of claim 8, wherein the second transistor is an N-type transistor and the first input terminal and the second input terminal of the second operational amplifier are negative input terminal and positive input terminal, respectively.

13. The voltage-controlled current source of claim 8, wherein the first transistor is an N-type transistor and the first input terminal and the second input terminal of the first operational amplifier are positive input terminal and negative input terminal, respectively.

14. The voltage-controlled current source of claim 8, wherein the second transistor is a P-type transistor and the first input terminal and the second input terminal of the second operational amplifier are positive input terminal and negative input terminal respectively.

15. A voltage-controlled current source for receiving a first control voltage and a second control voltage and using the first control voltage and the second control voltage to control a first output current and a second output current, respectively, the voltage-controlled current source comprising:

a first operational amplifier, wherein a first input terminal of the first operational amplifier receives the first control voltage;

a second operational amplifier, wherein a first input terminal of the second operational amplifier receives the second control voltage;

a first transistor, wherein a gate terminal of the first transistor is coupled to an output terminal of die first operational amplifier and a first source/drain terminal of the first transistor is coupled to a second input terminal of the first operational amplifier;

a second transistor, wherein a gate terminal of the second transistor is coupled to the output terminal of the first operational amplifier and a first source/drain terminal of the second transistor outputs the first output current;

a third transistor, wherein a gate terminal of the third transistor is coupled to an output terminal of the second operational amplifier and a first source/drain terminal of the third transistor is coupled to a second input terminal of the second operational amplifier;

a fourth transistor, wherein a gate terminal of the fourth transistor is coupled to the output terminal of the second operational amplifier and a first source/drain terminal of the fourth transistor outputs the second output current;

a resistor, wherein one terminal of the resistor is coupled to the first source/drain terminal of the first transistor and the other terminal of the resistor is coupled to the first source/drain terminal of the third transistor;

a first current minor having a reference side output terminal and an output side output terminal, wherein the reference side output terminal of the first current mirror is coupled to a second source/drain terminal of the first transistor and the output side output terminal of the first current mirror is coupled to a second source/drain terminal of the second transistor; and a second current mirror having a reference side output terminal and an output side output terminal, wherein the reference side output terminal of the second current mirror is coupled to a second source/drain terminal of the third transistor and the output side output terminal of the second current mirror is coupled to a second source/drain terminal of the fourth transistor.

16. The voltage-controlled current source of claim 15, wherein the first current mirror further comprises:

a fifth P-type transistor, wherein a source terminal of the fifth P-type transistor is coupled to a power supply voltage line and a drain terminal of the fifth P-type transistor is coupled to a gate terminal of the fifth P-type transistor, wherein the drain terminal of the fifth P-type transistor is the reference side output terminal; and a sixth P-type transistor, wherein a source terminal of the sixth P-type transistor is coupled to the power supply voltage line and a gate terminal of the sixth P-type transistor is coupled to the gate terminal of the fifth P-type transistor, wherein a drain terminal of the sixth P-type transistor is the output side output terminal.

17. The voltage-controlled current source of claim 15, wherein the second current minor further comprises:

a fifth N-type transistor, wherein a source terminal of the fifth N-type transistor is coupled to a ground wire and a drain terminal of the fifth N-type transistor is coupled to a gate terminal of the fifth N-type transistor, wherein the drain terminal of the fifth N-type transistor is the reference side output terminal; and a sixth N-type transistor, wherein a source terminal of the sixth N-type transistor is coupled to the ground wire and a gate terminal of the sixth N-type transistor is coupled to the gate terminal of the fifth N-type transistor, wherein a drain terminal of the sixth N-type transistor is the output side output terminal.

18. The voltage-controlled current source of claim 15, wherein the first transistor and the second transistor are P-type transistors and the first input terminal and the second input terminal of the first operational amplifier are negative input terminal and positive input terminal, respectively.

19. The voltage-controlled current source of claim 15, wherein the third transistor and the fourth transistor are N-type transistors and the first input terminal and the second input terminal of the second operational amplifier are negative input terminal and positive input terminal, respectively.

20. A voltage-controlled current source for receiving a first control voltage and a second control Voltage and using the first control voltage and the second control voltage to control a first output current and a second output current, respectively, the voltage-controlled current source comprising:

a first operational amplifier, wherein a first input terminal of the first operational amplifier receives the first control voltage;

a second operational amplifier, wherein a first input terminal of the second operational amplifier receives the second control voltage;

a first current minor having a reference side and an output side for controlling the reference current from the reference side output terminal according to the reference side control terminal such that the output side output terminal outputs an output current corresponding to the reference current, wherein the reference side control terminal of the first current mirror is coupled to an output terminal of the first operational amplifier and the output side output terminal of die first current mirror outputs the first output current;

a second current mirror having a reference side and an output side for controlling the reference current from the reference side output terminal according to the reference side control terminal such tat the output side output terminal outputs an output current corresponding to the reference current, wherein the reference side control terminal of the second current mirror is coupled to an output terminal of the second operational amplifier and the output side output terminal of the second current mirror outputs the second output current;

a resistor, wherein one side of the resistor is coupled to a second input terminal of the first operational amplifier and the reference side output terminal of the first current mirror and the other side of the resistor is coupled to a second input terminal of the second operational amplifier and the reference side output terminal of the second current mirror.

21. The voltage-controlled current source of claim 20, wherein the first current mirror comprises:

a first transistor, wherein a gate terminal of the first transistor is die reference side control terminal of the first current mirror and a first source/drain terminal of the first transistor is coupled to a power supply voltage line, wherein a second source/drain terminal of the first transistor is the reference side output terminal of the first current mirror;

a second transistor, wherein a gate terminal of the second transistor is coupled to the gate terminal of the first transistor and a first source/drain terminal of the second transistor is coupled to the power supply voltage line, wherein a second source/drain terminal of the second transistor is the output side output terminal of the first current mirror.

22. The voltage-controlled current source of claim 21, wherein the first transistor and the second transistor are P-type transistors.

23. The voltage-controlled current source of claim 21, wherein the second current mirror comprises:

a third transistor, wherein a gate terminal of the third transistor is the reference side control terminal of the second current mirror and a first source/drain terminal of the third transistor is coupled to a ground wire, wherein a second source/drain terminal of the third transistor is the reference side output terminal of the second current mirror;

a fourth transistor, wherein a gate terminal or the fourth transistor is coupled to the gate terminal of the first transistor and a first source/drain terminal of the fourth transistor is coupled to the ground wire, wherein a second source/drain terminal of the fourth transistor is the output side output terminal of the second current mirror.

24. The voltage-controlled current source of claim 23, wherein the third transistor and the fourth transistor are N-type transistors.

25. The voltage-controlled current source of claim 20, wherein the reference side of the first current mirror further comprises a bias voltage terminal for receiving a bias voltage, the first current mirror comprising:

a first transistor, wherein the gate terminal of the first transistor is the reference side control terminal of the first current mirror and the first source/drain terminal of the first transistor is coupled to the power supply voltage line;

a second transistor, wherein the gate terminal of the second transistor is coupled to the gate terminal of the first transistor and the first source/drain terminal of the second transistor is coupled to the power supply voltage line;

a third transistor, wherein the gate terminal of the third transistor is the reference side bias voltage terminal of the first current mirror and die first source/drain terminal of the third transistor is coupled to the second source/drain terminal of the first transistor, wherein the second source/drain terminal of the third transistor is the reference side output terminal of the first current mirror; and a fourth transistor, wherein the gate terminal of the fourth transistor is coupled to the gate terminal of the third transistor and the first source/drain terminal of the fourth transistor is coupled to the second source/drain terminal of the second transistor, wherein the second source/drain terminal of the fourth transistor is the output side output terminal of the first current minor.

26. The voltage-controlled current source of claim 25, wherein the first transistor, The second transistor, the third transistor and the fourth transistor are P-type transistors.

27. The voltage-controlled current source of claim 25, wherein the reference side of the second current mirror further comprises a bias voltage terminal for receiving a bias voltage, the second current mirror comprising;

a fifth transistor, wherein a gate terminal of the fifth transistor is the reference side control terminal of the second current mirror and a first source/drain terminal of the fifth transistor is coupled to a ground wire;

a sixth transistor, wherein a gate terminal of the sixth transistor is coupled to the gate terminal of the fifth transistor and a first source/drain terminal of the sixth transistor is coupled to the ground wire;

a seventh transistor, wherein a gate terminal of the seventh transistor is the reference side bias voltage terminal of the second current mirror, a first source/drain terminal of the seventh transistor is coupled to a second source/drain terminal of the fifth transistor and a second source/drain terminal of the seventh transistor is the reference side output terminal of the second current mirror; and an eighth transistor, wherein a gate terminal of the eighth transistor is coupled to the gate terminal of the seventh transistor, a first source/drain terminal of the eighth transistor is coupled to a second source/drain terminal of the sixth transistor and a second source/drain terminal of the eighth transistor is the output side output terminal of the second current mirror.

28. The voltage-controlled current source of claim 27, wherein the fifth transistor, the sixth transistor, the seventh transistor and the eighth transistor are N-type transistors.

* * * * *